US009349561B2

(12) United States Patent
Wang et al.

(10) Patent No.: US 9,349,561 B2
(45) Date of Patent: May 24, 2016

(54) IMPREGNATED YTTRIC OR GADOLINIUM-CONTAINING BARIUM-ALUMINUM-SCANDATE CATHODES AND THEIR FABRICATION METHODS

(75) Inventors: Jinshu Wang, Beijing (CN); Wei Liu, Beijing (CN); Fan Yang, Beijing (CN); Xiang Liu, Beijing (CN); Hongyi Li, Beijing (CN); Meiling Zhou, Beijing (CN); Tieyong Zuo, Beijing (CN)

(73) Assignee: BEIJING UNIVERSITY OF TECHNOLOGY, Beijing (CN)

( * ) Notice: Subject to any disclaimer, the term of this patent is extended or adjusted under 35 U.S.C. 154(b) by 1046 days.

(21) Appl. No.: 13/340,701

(22) Filed: Dec. 30, 2011

(65) Prior Publication Data

US 2013/0105742 A1 May 2, 2013

(30) Foreign Application Priority Data

Nov. 2, 2011 (CN) ..... 2011 1 0341108

(51) Int. Cl.

| | |
|---|---|
| ***H01J 1/14*** | (2006.01) |
| ***H01J 1/142*** | (2006.01) |
| ***H01J 1/13*** | (2006.01) |
| ***H01J 1/144*** | (2006.01) |
| ***H01J 9/04*** | (2006.01) |
| ***H01J 23/05*** | (2006.01) |

(52) U.S. Cl.

CPC . *H01J 1/142* (2013.01); *H01J 1/13* (2013.01); *H01J 1/14* (2013.01); *H01J 1/144* (2013.01); *H01J 9/047* (2013.01); *H01J 23/05* (2013.01)

(58) Field of Classification Search

CPC ..... H01J 1/13; H01J 1/14; H01J 1/28; H01J 1/144; H01J 1/16; H01B 1/22

USPC ..... 252/521.1; 313/346 R, 346 DC

See application file for complete search history.

(56) References Cited

U.S. PATENT DOCUMENTS

2011/0243184 A1* 10/2011 Nakabayashi et al. ..... 374/142
2014/0174913 A1* 6/2014 Gaertner et al. ..... 204/192.15

* cited by examiner

*Primary Examiner* — Khanh Tuan Nguyen
*Assistant Examiner* — Haidung Nguyen
(74) *Attorney, Agent, or Firm* — Han IP Corporation

(57) ABSTRACT

Impregnated rare earth metal-containing barium-aluminum-scandate cathodes with a rare earth oxide doped tungsten matrix and methods for the fabrication thereof are described. In one aspect, an impregnated rare earth metal-containing barium-aluminum-scandate cathode comprises: a rare earth oxide doped tungsten matrix, and an impregnated active substance. The active substance comprises scandium oxide ($Sc_2O_3$), a second rare earth oxide, and barium calcium aluminate, wherein the molar ratio of Ba:Ca:Al is about 4:1:1.

8 Claims, 7 Drawing Sheets

IMPREGNATED YTTRIC OR GADOLINIUM-CONTAINING BARIUM-ALUMINUM-SCANDATE CATHODES AND THEIR FABRICATION METHODS

CROSS-REFERENCE TO RELATED APPLICATION

This application claims priority to Chinese Patent Application No. 201110341108.3, filed Nov. 2, 2011, which is incorporated in its entirety herein by reference.

TECHNICAL FIELD

The present disclosure relates to a method of manufacturing an impregnated yttric or gadolinium-containing Barium-aluminum-scandate cathode with yttrium oxide/gadolinium oxide-tungsten matrix, which belongs to the technical field of rare earth-refractory metal cathodes.

BACKGROUND OF RELATED ART

Magnetrons, as an important kind of high power microwave devices, have a wide range of applications in many fields, such as military, medical and civil fields. As one of the key components of the magnetron, the cathode plays an important role in the operation of magnetrons. In order to develop high-power and high-frequency magnetrons, the cathodes are needed to have a certain thermionic emission and excellent secondary electron emission properties. Currently, Ba—W dispenser cathodes are generally used in the commercial magnetrons. However, Ba—W dispenser cathodes can not fulfill the requirements of the high power magnetrons due to their bad anti-bombarding insensitivity and poor secondary emission yields. It has been shown that REO-Mo cathodes exhibit an excellent secondary emission property and good anti-bombarding insensitivity. However, their low thermionic emission current density still limits their applications in the high power magnetrons. Therefore, there remains a need for developing a new type of cathodes possessing all desired properties for high power and millimeter-wave magnetron applications.

SUMMARY

The present disclosure provides an impregnated rare earth containing Barium aluminum-scandate cathode with a rare earth oxide doped tungsten matrix and methods for the fabrication.

In one aspect, an impregnated rare earth-containing Barium-aluminum-scandate cathode may comprise a first rare earth oxide doped tungsten matrix; and an impregnated active substance. The impregnated active substance may comprise scandium oxide ($Sc_2O_3$), a second rare earth oxide, and Barium-calcium-aluminate, wherein the molar ratio of Ba:Ca:Al is about 4:1:1.

In some embodiments, the concentration of the first rare earth oxide in the matrix ranges from 3 to 10% by weight.

In some embodiments, the first rare earth oxide in the matrix is yttrium oxide ($Y_2O_3$) or gadolinium oxide ($Gd_2O_3$).

In some embodiments, the concentration of the $Sc_2O_3$ in the impregnated active substance ranges from 2 to 6% by weight.

In some embodiments, the concentration of the second rare earth oxide in the impregnated active substance ranges from 3 to 5% by weight.

In some embodiments, the second rare earth oxide in the impregnated active substance is $Y_2O_3$, or $Gd_2O_3$.

In another aspect, an impregnated rare earth-containing Barium-aluminum-scandate cathode may comprise a first rare earth oxide doped tungsten matrix; and an impregnated active substance that comprises scandium oxide ($Sc_2O_3$), a second rare earth oxide, and Barium-calcium-aluminate; wherein the first and the second rare earth oxides are yttrium oxide ($Y_2O_3$) or gadolinium oxide ($Gd_2O_3$);

In some embodiments, the concentration of the first rare earth oxide in the matrix ranges from 3 to 10% by weight.

In some embodiments, the impregnated active substance comprises 2 to 6% in weight of $Sc_2O_3$, 3 to 5% by weight of $Y_2O_3$ or $Gd_2O_3$, and Barium-calcium-aluminate in the molar ratio of Ba:Ca:Al of 4:1:1.

In another aspect, a method for making the impregnated rare earth-containing Barium-aluminum-scandate cathodes may comprises: mixing a rare earth oxide with a tungsten powder; pressing the mixed powder into pellets under a pressure between 1.5 t/cm$^2$ to 4 t/cm$^2$; sintering the pellet under hydrogen at a temperature between 1500° C. and 1600° C. for 10 to 20 minutes to obtain a matrix; dissolving a raw material comprising scandium nitrate, Barium nitrate, calcium nitrate, aluminum nitrate, and rare earth nitrate in de-ionized water to obtain a raw material solution; titrating an excess amount of aqueous ammonium carbonate solution into the raw material solution until all cations are precipitated out; leaching the precipitated solid; drying the solid; calcining the dried solid under air/oxygen at a temperature between 650° C. and 950° C. for 2 to 5 hours; reacting the calcined solid under dry hydrogen at a temperature between 1500° C. and 1600° C. for 10 to 30 minutes to obtain an impregnated active substance; and impregnating the active substance into the matrix under hydrogen at a temperature between 1600° C. and 1650° C. for 1 to 3 minutes.

In some embodiments, the concentration of the rare earth oxide in the matrix ranges from 3 to 10% by weight.

In some embodiments, the rare earth oxide in the matrix is yttrium oxide ($Y_2O_3$) or gadolinium oxide ($Gd_2O_3$).

In some embodiments, the rare earth nitrate is yttrium nitrate, or gadolinium nitrate.

In some embodiments, the raw materials correspond to 2 to 6% by weight of $Sc_2O_3$, 3 to 5% by weight of $Y_2O_3$ or $Gd_2O_3$, and Barium-calcium-aluminates in the molar ratio of Ba:Ca:Al of 4:1:1.

In another aspect, a method for making a rare earth oxide doped tungsten matrix may comprise: mixing a rare earth oxide power and a tungsten powder; pressing the mixed powders into pellets; and sintering the pellet to obtain a matrix.

In some embodiments, the concentration of the rare earth oxide ranges from 3 to 10% by weight.

In some embodiments, the rare earth oxide powder and the tungsten power are mixed by mechanical mixing method.

In some embodiments, the rare earth oxide is yttrium oxide ($Y_2O_3$), or gadolinium oxide ($Gd_2O_3$).

In some embodiments, the mixed powders are pressed under a pressure between 1.5 t/cm$^2$ to 4 t/cm$^2$ to form pellets.

In some embodiments, the pellet is sintered under hydrogen at a temperature between 1500° C. and 1600° C. for 10 to 20 minutes.

In another aspect, a method for making an impregnated active substance may comprise: dissolving raw materials comprising scandium nitrate, barium nitrate, calcium nitrate, aluminum nitrate, and rare earth nitrate in de-ionized water to obtain a raw material solution; titrating an excess amount of aqueous ammonium carbonate solution into the raw material solution until all cations are precipitated out; leaching the precipitated solid from the solution; drying the solid; calcining the dried solid; and reacting the calcined solid under dry hydrogen to form an impregnated active substance.

In some embodiments, the rare earth nitrate is yttrium nitrate, or gadolinium nitrate.

In some embodiments, the raw materials correspond to 2 to 6% by weight of $Sc_2O_3$, 3 to 5% by weight of $Y_2O_3$ or $Gd_2O_3$, and Barium-calcium-aluminate in the molar ratio of Ba:Ca:Al of 4:1:1

In some embodiments, the solid is calcined under air/oxygen at a temperature between 650° C. and 950° C. for 2 to 5 hours In some embodiments, the solid is reacted under dry hydrogen at temperatures between 1500° C. and 1600° C. for 10 to 30 minutes.

In yet another aspect, a method for making an impregnated rare earth-containing Barium-aluminum-scandate cathode with a rare earth oxide doped tungsten matrix may comprises impregnating the active substance into the rare earth oxide doped tungsten matrix under hydrogen at a temperature between 1600° C. and 1650° C. for 1 to 3 minutes.

Thus, the present disclosure provides a method for fabricating an impregnated yttric or gadolinium-containing Barium-aluminum-scandate cathode with yttrium oxide ($Y_2O_3$)/gadolinium oxide ($Gd_2O_3$)-tungsten (W) matrix. The rare earth oxide $Y_2O_3$/$Gd_2O_3$ is doped into the matrix, and then the yttric or gadolinium-containing Barium-aluminum-scandate is impregnated into the matrix above in order to enhance the thermionic emission and secondary emission properties of the cathode.

There are a number of advantages provided by the techniques of the present disclosure. The impregnated yttric or gadolinium-containing Barium-aluminum-scandate cathode with yttrium oxide/gadolinium oxide-tungsten matrix provided by this present disclosure exhibits excellent secondary emission performance, i.e., the maximum secondary emission yield $\delta_{max}$ of the cathode with 10 wt % content of $Y_2O_3$ in the matrix is 3.51, and the thermionic emission current density of this cathode at 900° $C._b$ can reach 20.99 A/cm$^2$ after being activated. The maximum secondary emission yield $\delta_{max}$ of the cathode with 10 wt % content of $Gd_2O_3$ in the matrix is 3.87, and the thermionic emission current density of this cathode at 900° $C._b$ can reach 19.36 A/cm$^2$ after being activated. The performance of these two kinds of cathodes is better than that of Ba—W dispenser cathode used in the commercial magnetrons at present, which makes it possible for the practical application.

BRIEF DESCRIPTION OF THE DRAWINGS

The techniques of the present disclosure will now be described in detail with reference to the accompanying drawings.

DETAILED DESCRIPTION OF THE PREFERRED EMBODIMENTS

In the following description, impregnated rare earth-containing Barium-aluminum-scandate cathodes with a rare earth oxide doped tungsten matrices are obtained according to the present disclosure.

Figure 1:
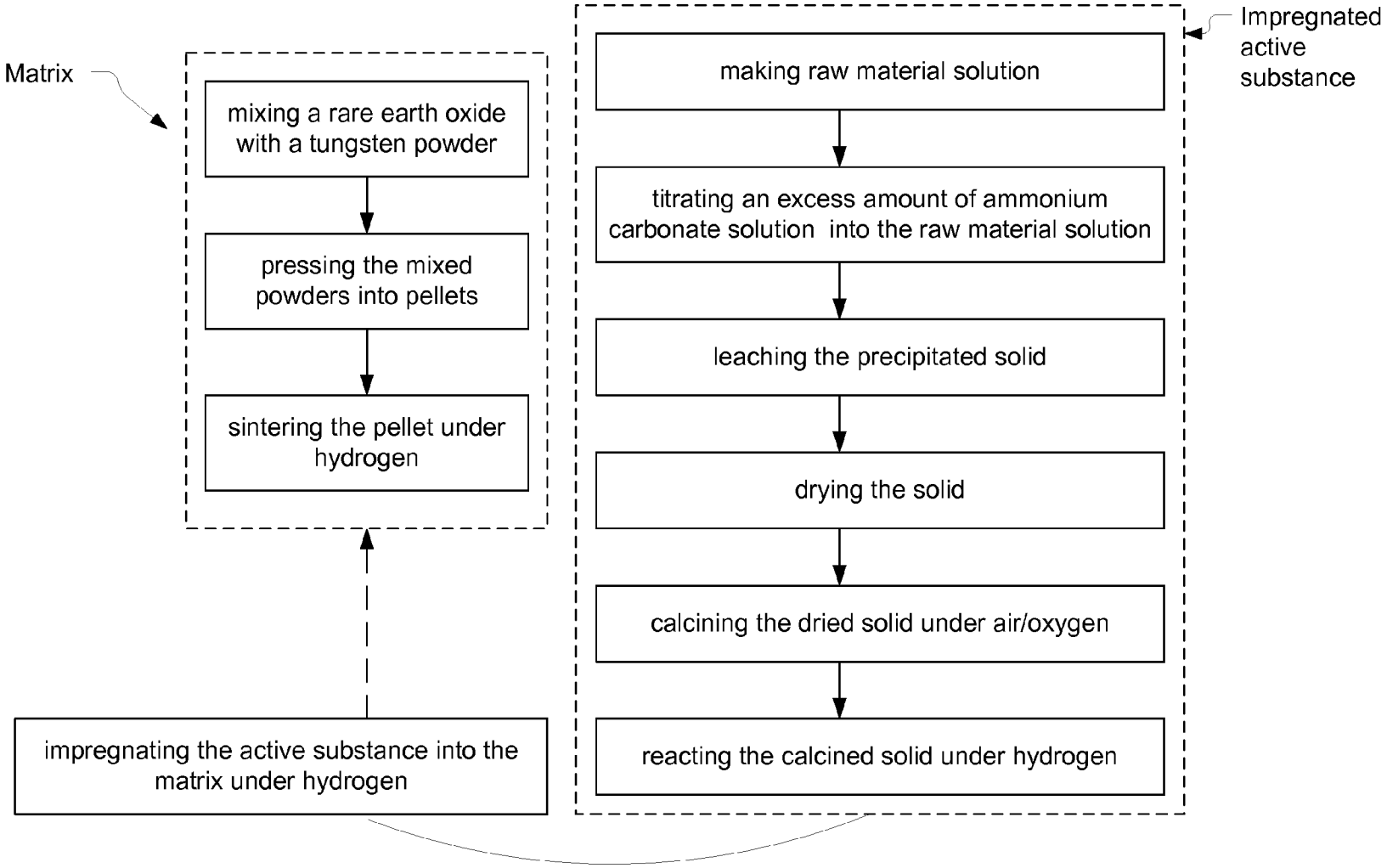
FIG. 1 is a flow diagram of one illustrated method for making an impregnated rare earth-containing Barium-aluminum-scandate cathode with a rare earth oxide doped tungsten matrix.

FIG. 1 is a flow diagram of one illustrated method for making an impregnated rare earth-containing Barium-aluminum-scandate cathode with a rare earth oxide doped tungsten matrix. Referring to FIG. 1, first, the rare earth oxide is mixed with the tungsten powders by a mechanical mixing method with 3 to 10 wt % of rare earth oxide. The mixed powders are then pressed into pellets at a pressure between 1.5 t/cm$^2$ to 4 t/cm$^2$. The pellet is sintered under hydrogen at a temperature between 1500° C. and 1600° C. for 10 to 20 minutes to form a rare earth oxide doped tungsten matrix. Secondly, rare earth nitrate (e.g., $Y(NO_3)_3.xH_2O$ or $Gd(NO_3)_3.xH_2O$), scandium nitrate ($Sc(NO_3)_3.xH_2O$), barium nitrate $Ba(NO_3)_2$, calcium nitrate ($Ca(NO_3)_2.xH_2O$), aluminum nitrate ($Al(NO_3)_3.xH_2O$) are dissolved in the de-ionized water, respectively, to obtain a raw material solution, and then an excess amount of aqueous ammonium carbonate$(NH_4)_2CO_3$ solution is titrated into the raw material solution until all cations are precipitated out. In the above molecular formulas, "x" is a positive integer, including zero, representing the number of crystal water in the molecule. Scandium nitrate, yttrium nitrate, gadolinium nitrate, calcium nitrate, and aluminum nitrate with various numbers of crystal water or without crystal water can be used in the present disclosure as the raw materials. The raw solution corresponds to 2-6 wt % of $Sc_2O_3$, 3-5 wt % of $Y_2O_3$/$Gd_2O_3$ and the rest of BaO, CaO and $Al_2O_3$ having molar ratio of Ba:Ca:Al of 4:1:1. After leaching and drying of the precipitates, the dried solid is calcined under air/oxygen at temperatures between 650° C. and 950° C. for 2 to 5 hours and then reacted under dry hydrogen at temperatures between 1500° C. and 1600° C. for 10 to 30 minutes to obtain the impregnated rare earth-containing Barium-aluminum-scandate active substance. Finally, the active substance is impregnated into the matrix under hydrogen at a temperature between 1600° C. and 1650° C. for 1 to 3 minutes to form an impregnated rare earth-containing Barium-aluminum-scandate cathode with a rare earth oxide doped tungsten matrix.

In some embodiments, the rare earth oxide is yttrium oxide ($Y_2O_3$), or gadolinium oxide ($Gd_2O_3$).

Figure 2:
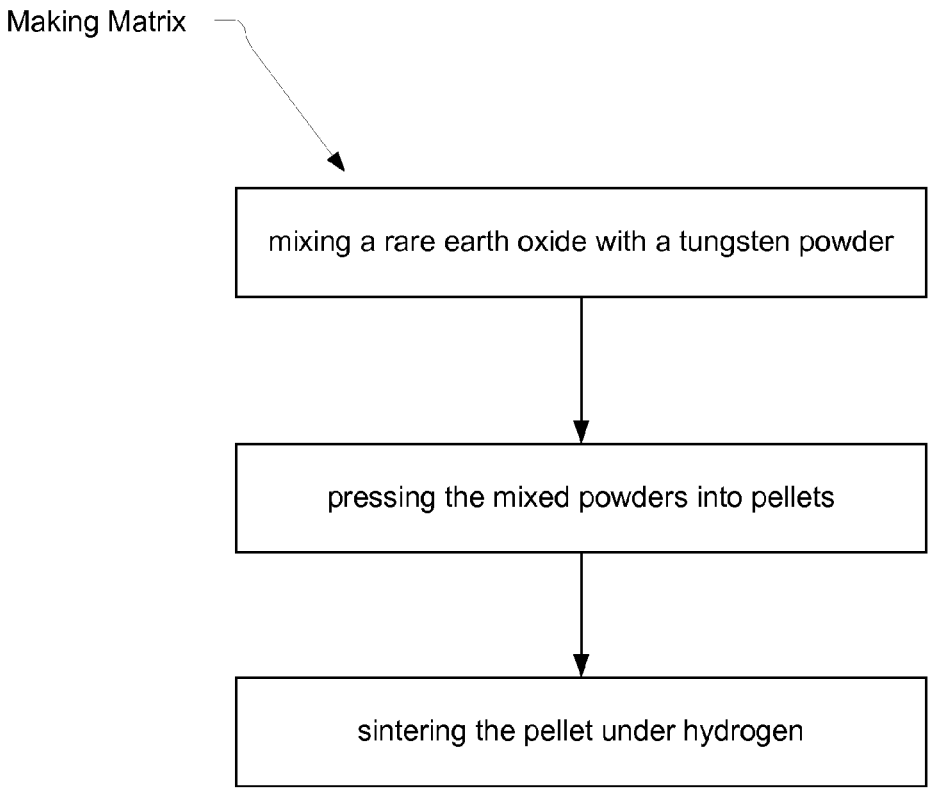
FIG. 2 is a flow diagram of one illustrated method for making a rare earth oxide doped tungsten matrix.

FIG. 2 is a flow diagram of one illustrated method for making a rare earth oxide doped tungsten matrix. Referring to FIG. 2, the rare earth oxide is first mixed with the tungsten powders. The mixed powders then are pressed into pellets. The pellet is finally sintered to form a rare earth oxide doped tungsten matrix.

In some embodiments, the concentration of the rare earth oxide ranges from 3 to 10 wt %.

In some embodiments, the rare earth oxide powder and the tungsten power are mixed by mechanical mixing method.

In some embodiments, the rare earth oxide is yttrium oxide ($Y_2O_3$), or gadolinium oxide ($Gd_2O_3$).

In some embodiments, the mixed powders are pressed under a pressure between 1.5 t/cm$^2$ to 4 t/cm$^2$ to form pellets.

In some embodiments, the pellet is sintered under hydrogen at a temperature between 1500° C. and 1600° C. for 10 to 20 minutes.

Figure 3:
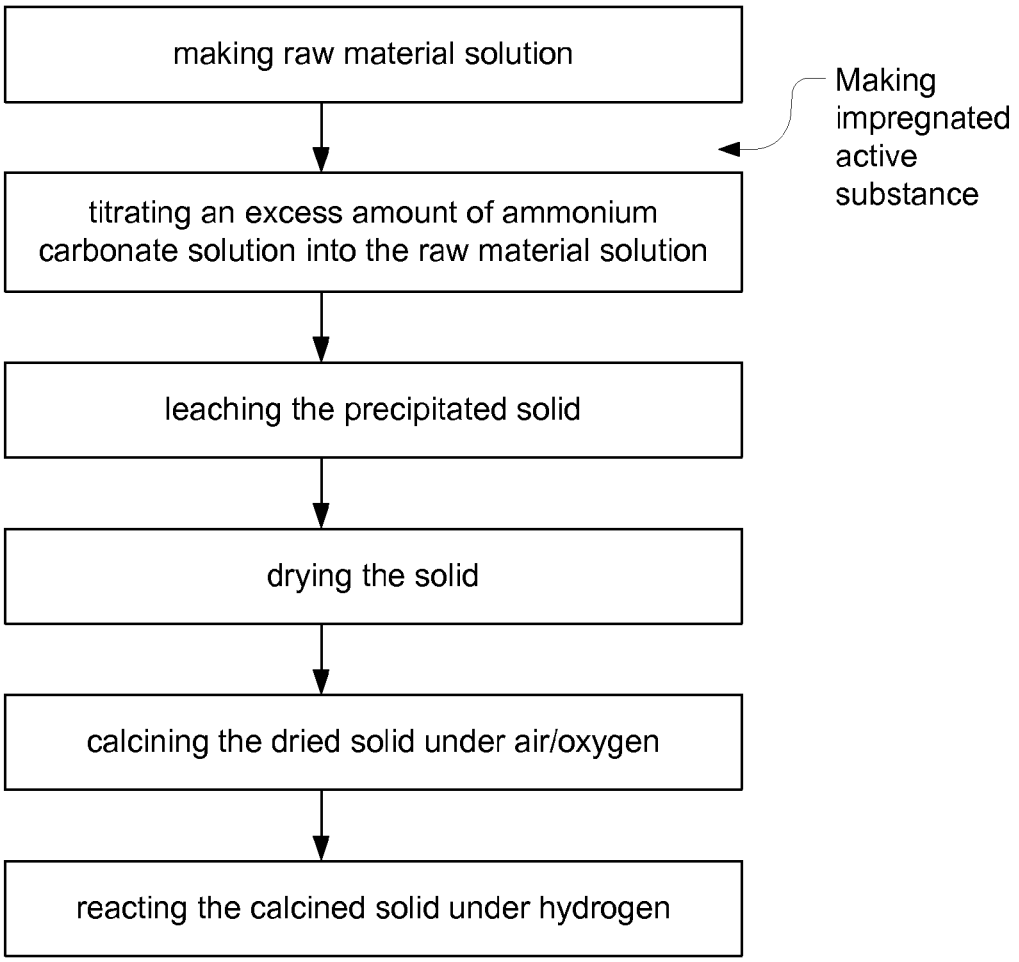
FIG. 3 is a flow diagram of one illustrated method for making an impregnated active substance.
Figure 4:
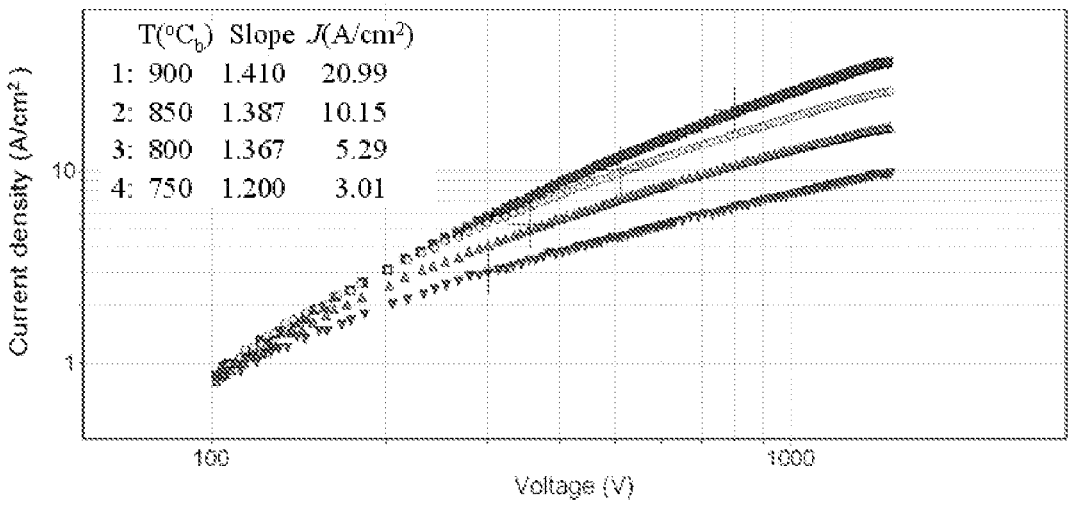
FIG. 4 is a graph of voltage versus current density curves of a cathode as illustrated in Example 1 with 3 wt % of $Y_2O_3$ in the matrix which is sintered in the atmosphere of hydrogen at 1500° C. for 10 minutes. The impregnated active substance contains 3 wt % of $Sc_2O_3$, 5 wt % of $Y_2O_3$ and 92 wt % of Barium-calcium-aluminate in the molar ratio of Ba:Ca:Al of 4:1:1.
Figure 5:
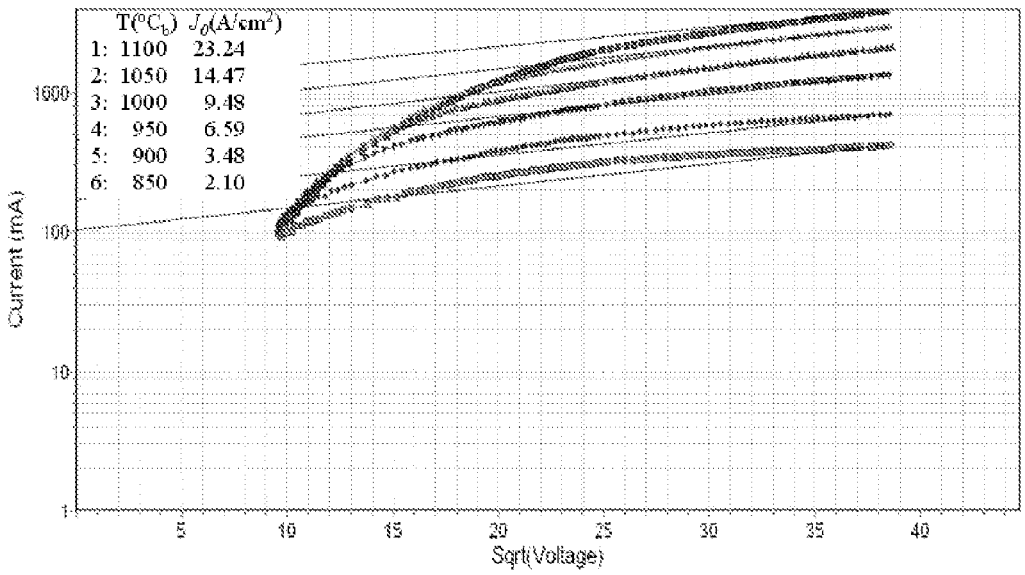
FIG. 5 is a graph of voltage versus current density curves of a Ba—W dispenser cathode at different temperatures after being activated.

FIG. 3 is a flow diagram of one illustrated method for making an impregnated active substance. Referring to FIG. 3, rare earth nitrate, scandium nitrate, barium nitrate, calcium nitrate, aluminum nitrate are dissolved in the de-ionized water, respectively, to obtain a raw material solution, and an excess amount of aqueous ammonium carbonate $(NH_4)_2CO_3$ solution is then titrated into the raw solution until all cations are precipitated out. After leaching and drying of the precipitates, the dried solid is calcined under air/oxygen and then reacted under dry hydrogen to obtain an impregnated rare earth-containing Barium-aluminum-scandate active substance.

In some embodiments, the rare earth nitrate is yttrium nitrate, or gadolinium nitrate.

In some embodiments, the raw materials correspond to 2 to 6 wt % of $Sc_2O_3$, 3 to 5 wt % of $Y_2O_3$ or $Gd_2O_3$, and Barium-calcium-aluminate in the molar ratio of Ba:Ca:Al of 4:1:1

In some embodiments, the solid is calcined under air/oxygen at a temperature between 650° C. and 950° C. for 2 to 5 hours In some embodiments, the solid is reacted under dry hydrogen at temperatures between 1500° C. and 1600° C. for 10 to 30 minutes.

An impregnated rare earth-containing Barium-aluminum-scandate cathode with a rare earth oxide doped tungsten matrix can be obtained by impregnating the active substance into the rare earth oxide doped tungsten matrix under hydrogen at a temperature between 1600° C. and 1650° C. for 1 to 3 minutes.

Figure 6:
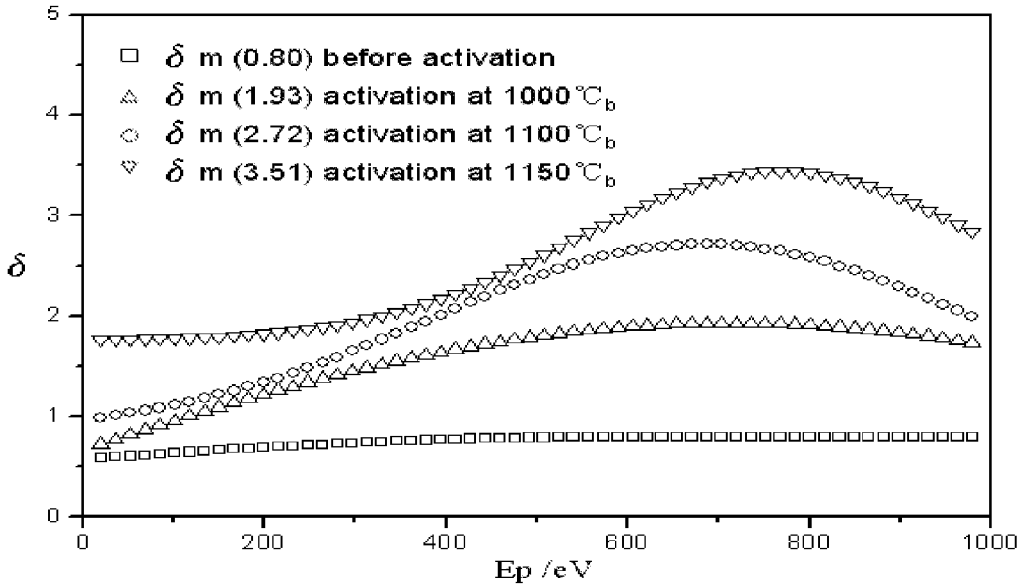
FIG. 6 is a graph of energy versus secondary emission yield curves of a cathode as illustrated in Example 5 with 10 wt % of $Y_2O_3$ in the tungsten matrix which is sintered in the atmosphere of hydrogen at 1550° C. for 10 minutes. The impregnated active substance contains 6 wt % of $Sc_2O_3$, 3 wt % of $Y_2O_3$ and 91 wt % of Barium-calcium-aluminate in the molar ratio of Ba:Ca:Al of 4:1:1.
Figure 7:
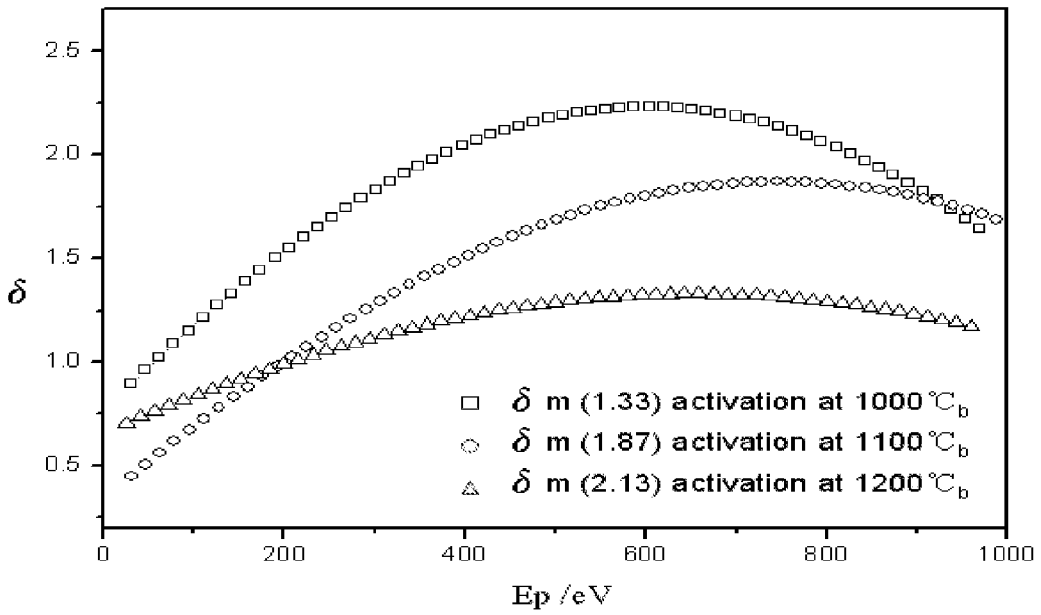
FIG. 7 is a graph of energy versus secondary emission yield curves of a Ba—W dispenser cathode activated at different temperatures.

The performance of rare earth-containing Barium-aluminum-scandate cathodes according to the present disclosure is evaluated and compared with that of conventional Ba—W dispenser cathode (FIG. 4-7, Table 1). The impregnated yttric or gadolinium-containing Barium-aluminum-scandate cathodes with yttrium oxide or gadolinium oxide doped tungsten matrices exhibit excellent secondary emission performance. As shown in FIG. 6, the maximum secondary emission yield $\delta_{max}$ of a cathode with 10 wt % $Y_2O_3$ doped in the tungsten matrix is 3.51, and its thermionic emission current density at 900° C. can reach 20.99 A/cm$^2$ after being activated. The maximum secondary emission yield $\delta_{max}$ of a cathode with 10 wt % of $Gd_2O_3$ doped in the tungsten matrix is 3.87, and the thermionic emission current density of this cathode at 900° C.$_b$ can reach 19.36 A/cm$^2$ after being activated. The impregnated yttric or gadolinium-containing Barium-aluminum-scandate cathodes show much enhanced secondary emission yield and thermionic emission current density comparing to Ba—W dispenser cathodes that are currently used in the commercial magnetrons, which makes them a promising candidate for high power magnetron applications.

EXAMPLES

Example 1

0.90 g of $Y_2O_3$ and 29.10 g of W powders were mixed by a mechanical mixing method, and then the powders were pressed into the pellets with the size of ϕ3×1.5 mm under the pressure of 4 t/cm$^2$. Finally, the pellets were sintered in the atmosphere of hydrogen at 1500° C. for 10 minutes and shaped into the matrices needed. The aqueous solution of 3.11 g of $Y(NO_3)_3.4H_2O$, 2.17 g of $Sc(NO_3)_3.4H_2O$, 24.94 g of $Ba(NO_3)_2$, 5.63 g of $Ca(NO_3)_2.4H_2O$, 17.90 g of $Al(NO_3)_3 9H_2O$ and 22.00 g of $(NH_4)_2CO_3$ was dissolved in the de-ionized water, respectively. The aqueous solution of nitric salt prepared in the first step was mixed together, and then excessive ammonium carbonate solution was titrated into the mixed aqueous solution until all cations are precipitated out. After leaching and drying, the powders were calcined in the atmosphere of air/oxygen at 650° C. for 2 h, and then reacted in the dry hydrogen at 1500° C. for 10 minutes to obtain the active substance which is subsequently impregnated into the matrices above at the temperature of 1600° C. for 1 minute, thus the impregnated yttric Barium-aluminum-scandate cathodes with yttrium oxide-tungsten matrices were obtained.

Example 2

1.50 g of $Y_2O_3$ and 28.50 g of W powders were mixed by a mechanical mixing method, and then the powders were pressed into the pellets with the size of ϕ10×1.5 mm under the pressure of 3 t/cm$^2$. Finally, the pellets were sintered in the atmosphere of hydrogen at 1550° C. for 15 minutes and shaped into the matrices needed. The aqueous solution of 1.86 g of $Y(NO_3)_3.4H_2O$, 1.44 g of $Sc(NO_3)_3.4H_2O$, 25.75 g of $Ba(NO_3)_2$, 5.82 g of $Ca(NO_3)_3.4H_2O$, 18.48 g of $Al(NO_3)_3.9H_2O$, and 22.00 g of $(NH_4)_2CO_3$ was dissolved in the de-ionized water, respectively. The aqueous solution of nitric salt prepared in the first step was mixed together, and then excessive ammonium carbonate solution was titrated into the mixed aqueous solution until all cations are precipitated out. After leaching and drying, the powders were calcined in the atmosphere of air/oxygen at 750° C. for 3 h, and then reacted in the dry hydrogen at 1550° C. for 20 minutes to obtain the active substance which is subsequently impregnated into the matrices above at the temperature of 1650° C. for 2 minutes, thus the impregnated yttric Barium-aluminum-scandate cathodes with yttrium oxide-tungsten matrices were obtained.

Example 3

2.10 g of $Y_2O_3$ and 27.90 g of W powders were mixed by a mechanical mixing method, and then the powders were pressed into the pellets with the size of ϕ10×1.5 mm under the pressure of 2 t/cm$^2$. Finally, the pellets were sintered in the atmosphere of hydrogen at 1600° C. for 20 minutes and shaped into the matrix needed. The aqueous solution of 2.49 g of $Y(NO_3)_3.4H_2O$, 2.89 g of $Sc(NO_3)_3.4H_2O$, 24.94 g of $Ba(NO_3)_2$, 5.63 g of $Ca(NO_3)_3.4H_2O$, 17.90 g of $Al(NO_3)_3.9H_2O$ and 22.00 g of $(NH_4)_2CO_3$ was dissolved in the de-ionized water, respectively. The aqueous solution of nitric salt prepared in the first step was mixed together, and then excessive ammonium carbonate solution was titrated into the mixed aqueous solution until all cations are precipitated out. After leaching and drying, the powders were calcined in the atmosphere of air/oxygen at 850° C. for 4 h, and then reacted in the dry hydrogen at 1600° C. for 30 minutes to obtain the active substance which is subsequently impregnated into the matrices above at the temperature of 1650° C. for 3 minutes, thus the impregnated yttric Barium-aluminum-scandate cathodes with yttrium oxide-tungsten matrices were obtained.

Example 4

2.70 g of $Y_2O_3$ and 27.30 g of W powders were mixed by a mechanical mixing method, and then the powders were pressed into the pellets with the size of ϕ10×1.5 mm under the pressure of 1.5 t/cm$^2$. Finally, the pellets were sintered in the atmosphere of hydrogen at 1500° C. for 15 minutes and shaped into the matrices needed. The aqueous solution of 2.49 g of $Y(NO_3)_3.4H_2O$, 3.61 g of $Sc(NO_3)_3.4H_2O$, 24.66 g of $Ba(NO_3)_2$, 5.57 g of $Ca(NO_3)_3.4H_2O$, 17.70 g of $Al(NO_3)_3.9H_2O$ and 22.00 g of $(NH_4)_2CO_3$ was dissolved in the de-ionized water, respectively. The aqueous solution of nitric salt prepared in the first step was mixed together, and then excessive ammonium carbonate solution was titrated into the mixed aqueous solution until all cations are precipitated out. After leaching and drying, the powders were calcined in the atmosphere of air/oxygen at 950° C. for 5 h, and then reacted in the dry hydrogen at 1500° C. for 20 minutes to obtain the active substance which is subsequently impregnated into the matrices above at the temperature of 1650° C. for 1 minute, thus the impregnated yttric Barium-aluminum-scandate cathodes with yttrium oxide-tungsten matrices were obtained.

Example 5

3.00 g of $Y_2O_3$ and 27.00 g of W powders were mixed by a mechanical mixing method, and then the powders were pressed into the pellets with the size of ϕ10×1.5 mm under the pressure of 4 t/cm$^2$. Finally, the pellets were sintered in the atmosphere of hydrogen at 1550° C. for 10 minutes and shaped into the matrices needed. The aqueous solution of 1.86 g of $Y(NO_3)_3.4H_2O$, 4.33 g of $Sc(NO_3)_3.4H_2O$, 24.66 g of $Ba(NO_3)_2$, 5.57 g of $Ca(NO_3)_2.4H_2O$, 17.70 g of $Al(NO_3)_3.9H_2O$ and 22.00 g of $(NH_4)_2CO_3$ was dissolved in the de-ionized water, respectively. The aqueous solution of nitric salt prepared in the first step was mixed together, and then excessive ammonium carbonate solution was titrated into the mixed aqueous solution until all cations are precipitated out. After leaching and drying, the powders were calcined in the atmosphere of air/oxygen at 700° C. for 4 h, and then reacted in the dry hydrogen at 1550° C. for 10 minutes to obtain the active substance which is subsequently impregnated into the matrices above at the temperature of 1600° C. for 2 minutes, thus the impregnated yttric Barium-aluminum-scandate cathodes with yttrium oxide-tungsten matrices were obtained.

Example 6

0.90 g of $Gd_2O_3$ and 29.10 g of W powders were mixed by a mechanical mixing method, and then the powders were pressed into the pellets with the size of ϕ3×1.5 mm under the pressure of 4 t/cm$^2$. Finally, the pellets were sintered in the atmosphere of hydrogen at 1500° C. for 10 minutes and shaped into the matrices needed. The aqueous solution of 1.37 g of $Gd(NO_3)_3.4H_2O$, 1.44 g of $Sc(NO_3)_3.4H_2O$, 25.75 g of $Ba(NO_3)_2$, 5.82 g of $Ca(NO_3)_2.4H_2O$, 18.48 g of $Al(NO_3)_3.9H_2O$ and 22.00 g of $(NH_4)_2CO_3$ was dissolved in the de-ionized water, respectively. The aqueous solution of nitric salt prepared in the first step was mixed together, and then excessive ammonium carbonate solution was titrated into the mixed aqueous solution until all cations are precipitated out. After leaching and drying, the powders were calcined in the atmosphere of air/oxygen at 650° C. for 2 h, and then reacted in the dry hydrogen at 1600° C. for 20 minutes to obtain the active substance which is subsequently impregnated into the matrices above at the temperature of 1600° C. for 3 minutes, thus the impregnated gadolinium-containing Barium-aluminum-scandate cathodes with gadolinium oxide-tungsten matrices were obtained.

Example 7

1.50 g of $Gd_2O_3$ and 28.50 g of W powders were mixed by a mechanical mixing method, and then the powders were pressed into the pellets with the size of ϕ10×1.5 mm under the pressure of 3 t/cm$^2$. Finally, the pellets were sintered in the atmosphere of hydrogen at 1550° C. for 15 minutes and shaped into the matrices needed. The aqueous solution of 1.83 g of $Gd(NO_3)_3.4H_2O$, 2.17 g of $Sc(NO_3)_3.4H_2O$, 25.21 g of $Ba(NO_3)_2$, 5.69 g of $Ca(NO_3)_2.4H_2O$, 18.09 g of $Al(NO_3)_3.9H_2O$ and 22.00 g of $(NH_4)_2CO_3$ was dissolved in the de-ionized water, respectively. The aqueous solution of nitric salt prepared in the first step was mixed together, and then excessive ammonium carbonate solution was titrated into the mixed aqueous solution until all cations are precipitated out. After leaching and drying, the powders were calcined in the atmosphere of air/oxygen at 750° C. for 3 h, and then reacted in the dry hydrogen at 1600° C. for 10 minutes to obtain the active substance which is subsequently impregnated into the matrices above at the temperature of 1600° C. for 1 minute, thus the impregnated gadolinium-containing Barium-aluminum-scandate cathodes with gadolinium oxide-tungsten matrices were obtained.

Example 8

2.10 g of $Gd_2O_3$ and 27.90 g of W powders were mixed by a mechanical mixing method, and then the powders were pressed into the pellets with the size of ϕ10×1.5 mm under the pressure of 2 t/cm$^2$. Finally, the pellets were sintered in the atmosphere of hydrogen at 1600° C. for 20 minutes and shaped into the matrices needed. The aqueous solution of 2.29 g of $Gd(NO_3)_3.4H_2O$, 2.89 g of $Sc(NO_3)_3.4H_2O$, 24.66 g of $Ba(NO_3)_2$, 5.57 g of $Ca(NO_3)_2.4H_2O$, 17.70 g of $Al(NO_3)_3.9H_2O$ and 22.00 g of $(NH_4)_2CO_3$ was dissolved in the de-ionized water, respectively. The aqueous solution of nitric salt prepared in the first step was mixed together, and then excessive ammonium carbonate solution was titrated into the mixed aqueous solution until all cations are precipitated out. After leaching and drying, the powders were calcined in the atmosphere of air/oxygen at 850° C. for 4 h, and then reacted in the dry hydrogen at 1500° C. for 30 minutes to obtain the active substance which is subsequently impregnated into the matrices above at the temperature of 1650° C. for 2 minutes, thus the impregnated gadolinium-containing Barium-aluminum-scandate cathodes with gadolinium oxide-tungsten matrices were obtained.

Example 9

2.70 g of $Gd_2O_3$ and 27.30 g of W powders were mixed by a mechanical mixing method, and then the powders were pressed into the pellets with the size of ϕ10×1.5 mm under the pressure of 1.5 t/cm$^2$. Finally, the pellets were sintered in the atmosphere of hydrogen at 1500° C. for 15 minutes and shaped into the matrices needed. The aqueous solution of 1.83 g of $Gd(NO_3)_3.4H_2O$, 4.33 g of $Sc(NO_3)_3.4H_2O$, 24.39 g of $Ba(NO_3)_2$, 5.51 g of $Ca(NO_3)_2.4H_2O$, 17.51 g of $Al(NO_3)_3.9H_2O$ and 22.00 g of $(NH_4)_2CO_3$ was dissolved in the de-ionized water, respectively. The aqueous solution of nitric salt prepared in the first step was mixed together, and then excessive ammonium carbonate solution was titrated into the mixed aqueous solution until all cations are precipitated out. After leaching and drying, the powders were calcined in the atmosphere of air/oxygen at 950° C. for 5 h, and then reacted in the dry hydrogen at 1550° C. for 30 minutes to obtain the active substance which is subsequently impregnated into the matrices above at the temperature of 1650° C. for 3 minutes, thus the impregnated gadolinium-containing Barium-aluminum-scandate cathodes with gadolinium oxide-tungsten matrices were obtained.

Example 10

3.00 g of $Gd_2O_3$ and 27.00 g of W powders were mixed by a mechanical mixing method, and then the powders were pressed into the pellets with the size of $\phi 10 \times 1.5$ mm under the pressure of 4 t/cm$^2$. Finally, the pellets were sintered in the atmosphere of hydrogen at 1550° C. for 10 minutes and shaped into the matrices needed. The aqueous solution of 1.37 g of $Gd(NO_3)_3.4H_2O$, 3.61 g of $Sc(NO_3)_3.4H_2O$, 24.94 g of $Ba(NO_3)_2$, 5.63 g of $Ca(NO_3)_2.4H_2O$, 17.90 g of $Al(NO_3)_3.9H_2O$ and 22.00 g of $(NH_4)_2CO_3$ was dissolved in the de-ionized water, respectively. The aqueous solution of nitric salt prepared in the first step was mixed together, and then excessive ammonium carbonate solution was titrated into the mixed aqueous solution until all cations are precipitated out. After leaching and drying, the powders were calcined in the atmosphere of air/oxygen at 700° C. for 4 h, and then reacted in the dry hydrogen at 1600° C. for 20 minutes to obtain the active substance which is subsequently impregnated into the matrices above at the temperature of 1600° C. for 1 minute, thus the impregnated gadolinium-containing Barium-aluminum-scandate cathodes with gadolinium oxide-tungsten matrices were obtained.

The maximum secondary emission yield obtained from Examples 2-5 and 7-10 are summarized in Table 1.

TABLE 1

The maximum secondary emission yield $\delta_{max}$ obtained from Examples 2-5 and 7-10

| Samples | $\delta_{max}$ |
|---|---|
| Example 2 | 2.87 |
| Example 3 | 3.14 |
| Example 4 | 3.38 |
| Example 5 | 3.51 |

TABLE 1-continued

The maximum secondary emission yield $\delta_{max}$ obtained from Examples 2-5 and 7-10

| Samples | $\delta_{max}$ |
|---|---|
| Example 7 | 2.98 |
| Example 8 | 3.21 |
| Example 9 | 3.63 |
| Example 10 | 3.87 |

What is claimed is:

1. An impregnated rare earth-containing barium-aluminum-scandate cathode, comprising:

a tungsten matrix doped with a first rare earth oxide; and an impregnated active substance that comprises scandium oxide ($Sc_2O_3$), a second rare earth oxide, and Barium-calcium-aluminate, wherein a molar ratio of Ba:Ca:Al of the Barium-calcium-aluminate is 4:1:1, wherein the first rare earth oxide comprises yttrium oxide ($Y_2O_3$) or gadolinium oxide ($Gd_2O_3$), and wherein the second rare earth oxide comprises $Gd_2O_3$.

2. The impregnated rare earth-containing Barium-aluminum-scandate cathode of claim 1, wherein the concentration of the first rare earth oxide ranges from 3 to 10% by weight.

3. The impregnated rare earth-containing Barium-aluminum-scandate cathode of claim 1, wherein the concentration of the $Sc_2O_3$ ranges from 2to 6% by weight.

4. The impregnated rare earth-containing Barium-aluminum-scandate cathode of claim 1, wherein concentration of the second rare earth oxide ranges from 3 to 5% by weight.

5. An impregnated rare earth-containing Barium-aluminum-scandate cathode of claim 1, wherein the second rare earth oxide further comprises $Y_2O_3$.

6. An impregnated rare earth-containing Barium-aluminum-scandate cathode, comprising:

a tungsten matrix doped with a first rare earth oxide; and an impregnated active substance that comprises scandium oxide ($Sc_2O_3$), a second rare earth oxide, and Barium-calcium-aluminate;

wherein the first and the second rare earth oxides are gadolinium oxide ($Gd_2O_3$).

7. The impregnated rare earth-containing Barium-aluminum-scandate cathode of claim 6, wherein the concentration of the first rare earth oxide in the matrix ranges from 3 to 10% by weight.

8. The impregnated rare earth-containing Barium-aluminum-scandate cathode of claim 6, wherein the active substance comprises 2 to 6% by weight of $Sc_2O_3$, 3 to 5% by weight of $Gd_2O_3$, and Barium-calcium-aluminates in the molar ratio of Ba:Ca:Al of 4:1:1.

* * * * *